US007735973B2

(12) United States Patent
Ishizuka

(10) Patent No.: US 7,735,973 B2
(45) Date of Patent: Jun. 15, 2010

(54) LIQUID DISCHARGE HEAD AND METHOD FOR MANUFACTURING LIQUID DISCHARGE HEAD

(75) Inventor: Kazunari Ishizuka, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 586 days.

(21) Appl. No.: 11/773,718

(22) Filed: Jul. 5, 2007

(65) Prior Publication Data

US 2008/0024560 A1 Jan. 31, 2008

(30) Foreign Application Priority Data

Jul. 27, 2006 (JP) ..... 2006-204961

(51) Int. Cl.
*B41J 2/05* (2006.01)

(52) U.S. Cl. ..... 347/65

(58) Field of Classification Search ..... 347/65, 347/54–59, 61–63, 50, 44, 20, 14, 9, 5; 29/23.35
See application file for complete search history.

(56) References Cited

U.S. PATENT DOCUMENTS 5,478,606 A 12/1995 Ohkuma et al.
6,926,391 B2 * 8/2005 Yang et al. ..... 347/65
7,018,017 B2 * 3/2006 Song et al. ..... 347/56
7,207,662 B2 * 4/2007 Shin et al. ..... 347/63

* cited by examiner

*Primary Examiner*—K. Feggins
(74) *Attorney, Agent, or Firm*—Fitzpatrick, Cella, Harper & Scinto

(57) ABSTRACT

A liquid discharge head includes a substrate including energy-generating elements that generate energy used to discharge a liquid, discharge ports through which the liquid is discharged, and a channel-forming member having a channel in which the liquid flows and which is communicatively connected to the discharge ports. The channel-forming member includes a first layer and a second layer. The first and second layers are formed from negative-type photosensitive resin compositions containing a photopolymerization initiator. The first layer is located between the second layer and the substrate. The content of the photopolymerization initiator in the first layer is greater than the content of the photopolymerization initiator in the second layer.

12 Claims, 2 Drawing Sheets

LIQUID DISCHARGE HEAD AND METHOD FOR MANUFACTURING LIQUID DISCHARGE HEAD

BACKGROUND OF THE INVENTION

1. Field of the Invention

The present invention relates to liquid discharge heads for discharging liquids and methods for manufacturing the liquid discharge heads. The present invention particularly relates to a liquid discharge head for discharging ink onto a recording medium and also relates to a method for manufacturing the liquid discharge head.

2. Description of the Related Art

An example of a process using a liquid discharge head is an ink-jet recording process for discharging a liquid onto a recording media. An ink-jet recording head suitable for use in an ink-jet recording process includes fine discharge ports, a liquid channel, and energy-generating elements for generating energy used to discharge a liquid present in a portion of the liquid channel.

U.S. Pat. No. 5,478,606 discloses a method for manufacturing an ink-jet recording head suitable for use in an ink-jet recording process. In the method, a soluble resin pattern for an ink (liquid) channel is formed on a substrate having energy-generating elements. The following layer is deposited on the ink channel pattern: a resin coating layer, containing an epoxy resin and a cationic photopolymerization initiator, for forming walls of the ink channel. Discharge ports are formed in the resin coating layer by photolithography so as to be located above the energy-generating elements. The soluble resin is removed by dissolution, and the resin coating layer is then cured, whereby the ink channel walls are formed.

In such a process, the exposure operation used to form the ink channel pattern and the photolithography used to form the discharge ports require great attention to detail as described below. If light is applied to a first surface of the resin coating layer that is opposite to the substrate, the intensity of the light is reduced while the light is traveling from the first surface thereof to the substrate, because the resin coating layer absorbs light. Therefore, in order to securely bond the ink channel walls to the substrate, the light needs to reach a second surface of the resin coating layer that is in contact with the substrate. This allows a portion of the resin coating layer (the epoxy resin) that is located close to the substrate to be sufficiently cured, whereby the ink channel walls are allowed to have ink resistance and can be securely bonded to the substrate. Accordingly, since the light is applied to the first surface of the resin coating layer but must reach the surface in contact with the substrate, the following is important to note. A portion of the light that reaches the substrate is attenuated and therefore has appropriate intensity. However, a portion of the light that travels in a surface region of the resin coating layer is not attenuated yet and has excessively high intensity. The portion of the light having excessively high intensity may prevent the discharge ports from being precisely formed. That is, the following problem can occur: the portion of the light having excessively high intensity may damage a pattern for the discharge ports and/or the ink channel pattern. Occurrence of this problem can lead to a variation in the direction in which droplets are ejected and/or a variation in the size of the droplets. This, in turn, may affect an image that is formed with the ink-jet recording head.

SUMMARY OF THE INVENTION

The present invention provides a liquid discharge head in which a channel-forming member is tightly bonded to a substrate and has high strength and which has precisely-formed discharge ports. The present invention also provides a method for manufacturing the liquid discharge head.

A liquid discharge head according to an aspect of the present invention includes a substrate including energy-generating elements that generate energy used to discharge a liquid, discharge ports through which the liquid is discharged, and a channel-forming member having a channel in which the liquid flows and which is communicatively connected to the discharge ports. The channel-forming member includes a first layer and a second layer. The first and second layers are formed from a negative-type photosensitive resin composition containing a photopolymerization initiator. The first layer is located between the second layer and the substrate. The content of the photopolymerization initiator in the first layer is greater than the content of the photopolymerization initiator in the second layer.

Further features of the present invention will become apparent from the following description of exemplary embodiments with reference to the attached drawings.

DESCRIPTION OF THE EMBODIMENTS

Embodiments of the present invention will now be described in detail with reference to the attached drawings.

Liquid discharge heads described below can be mounted in printers, copiers, facsimile machines including communication systems, word processors including printer sections, and industrial recording apparatuses including processors. The liquid discharge heads are useful in recording data on various recording media made of paper, thread, fiber, fabric, leather, metal, plastic, glass, wood, or ceramic. The term "recording" used herein shall mean not only providing a meaningful image such as a letter, a character, or a figure on a recording medium, but also providing a meaningless image such as a pattern on a recording medium.

The term "ink" or "liquid" used herein should be construed broadly and shall mean a liquid that is provided on a recording medium such that an image, a figure, or a pattern is formed on the recording medium. In addition, according to the present invention, the recording medium or ink may be treated; treatment of the recording medium or ink provided on the recording medium is as follows: a colorant contained in the ink is solidified or insolubilized such that the fixation of the ink, the coloration of the ink, the quality of a recorded image, the durability of the recorded image, and/or the like is improved.

First Embodiment

Figure 1:
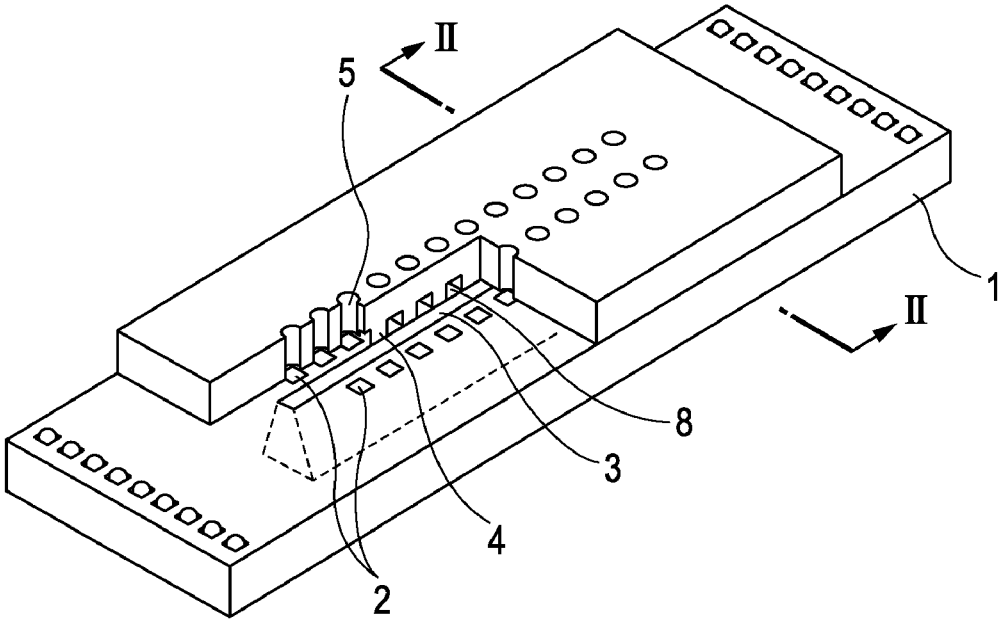
FIG. 1 is a schematic perspective view of a liquid discharge head according to a first embodiment of the present invention.

FIG. 1 shows a liquid discharge head according to a first embodiment of the present invention.

The liquid discharge head includes a substrate 1, made of silicon, including energy-generating elements (ink discharge energy-generating elements) 2 for generating energy used to discharge a liquid. The energy-generating elements 2 are arranged in two rows at predetermined intervals. The substrate 1 has a supply port 3, formed by etching the substrate 1, extending between the two rows of the energy-generating elements 2. The substrate 1 is overlaid with a channel-forming member 4 which has discharge ports 5 located at positions corresponding to the energy-generating elements 2 and which has a channel 8 communicatively connecting the supply port 3 to the discharge ports 5. The positions of the discharge ports 5 are not limited to positions opposed to the energy-generating elements 2.

The liquid discharge head is placed such that a surface of the liquid discharge head that has the supply port 3 is opposed to a recording surface of a recording medium. In the liquid discharge head, the energy generated by the energy-generating elements 2 is applied to ink supplied to the channel 8 through the supply port 3 such that droplets of the ink are discharged from the discharge ports 5, whereby the ink droplets are applied to the recording medium. Examples of the energy-generating elements 2 include, but are not limited to, electrothermal transducers (so-called heaters) for generating thermal energy and piezoelectric transducers for generating mechanical energy.

Figure 2:
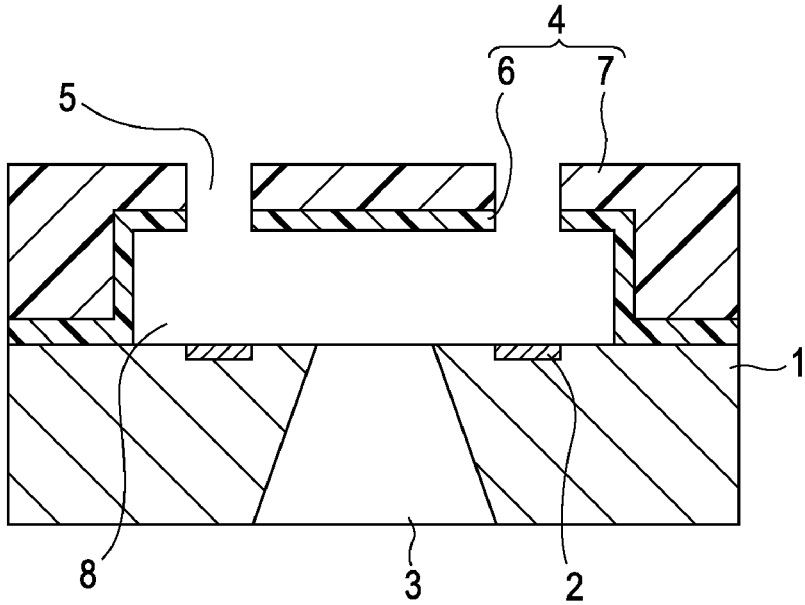
FIG. 2 is a cross-sectional view of the liquid discharge head taken along the line II-II of FIG. 1.

FIG. 2 shows the liquid discharge head in cross-section taken along the line II-II of FIG. 1.

With reference to FIG. 2, the channel-forming member 4, which has the channel 8 communicatively connecting the supply port 3 to the discharge ports 5, includes a first layer 6 and a second layer 7 disposed thereon. The first layer 6 is located between the substrate 1 and the second layer 7. The first and second layers 6 and 7 are preferably made of a negative-type photosensitive resin composition that can be optically patterned and more preferably made of a negative-type photosensitive resin composition that is cured by light irradiation. The channel-forming member 4 may further include a functional layer, such as a hydrophobic layer, or a layer made of another negative-type photosensitive resin composition in addition to the first and second layers 6 and 7. The negative-type photosensitive resin composition for forming the first and second layers 6 and 7 principally contains a base resin and a photopolymerization initiator. The negative-type photosensitive resin composition containing a photopolymerization initiator used to form the first and second layers may be the same or different with regard to the materials used; in other words, either the base resin, the photopolymerization initiator or both may be different as between first and second negative-type photosensitive resin compositions used to respectively form the first and second layers.

The photopolymerization initiator functions by causing the base resin to be cured when the photopolymerization initiator absorbs light. The base resin and the photopolymerization initiator may be arbitrarily combined. When the base resin is cationically polymerizable, the photopolymerization initiator is preferably a cationic photoinitiator, from which an acid is generated by light irradiation to initiate cationic polymerization. The photopolymerization initiator exhibits the curing function as described above. In particular, the curing function thereof is to generate or emit an active species at an initial stage of a curing reaction (polymerization) or to generate or emit a catalytic substance promoting specific polymerization.

Examples of the base resin include cationically polymerizable resins, anionically polymerizable resins, and radically polymerizable resins.

Examples of cationically polymerizable resins include epoxy resins, vinyl ether resins, and oxetane resins.

Examples of epoxy resins include alicyclic epoxy resins, bisphenol-type epoxy resins, novolac-type epoxy resins, glycidyl ester-type epoxy resins, and epoxy resins having one of the following formulae:

(I)

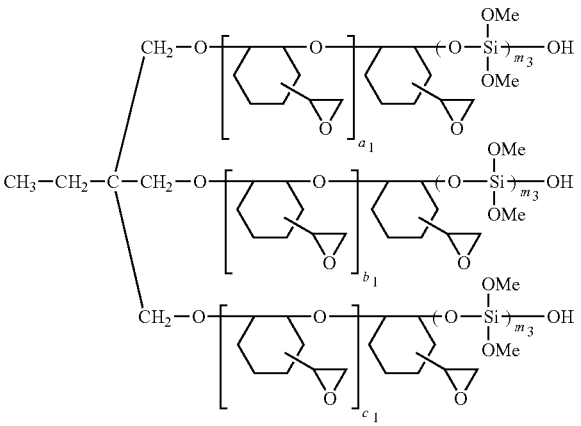

$a_1 + b_1 + c_1 \approx 15$, $m_2 = m_3 = m_4 \approx 3 \sim 10$ and (II)

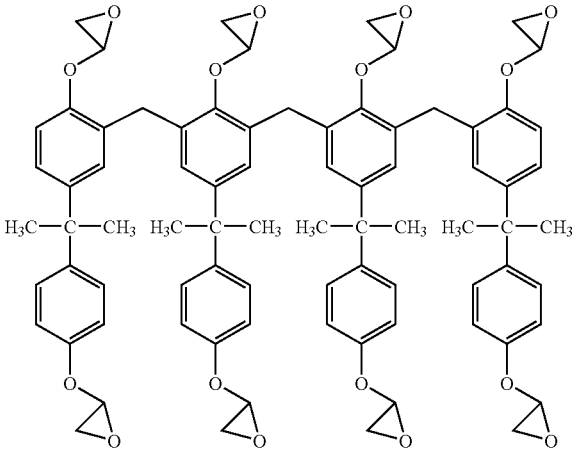

wherein the sum of $a_1$, $b_1$, and $c_1$ is equal to about 15 and $m_2$, $m_3$, and $m_4$ are equal to about 3-10.

Examples of anionically polymerizable resins include polyacrylonitrile, polymethylmethacrylate, polystyrene, and polybutadiene.

Examples of radically polymerizable resins include polyurethane acrylates, epoxy acrylate resins, and polyester acrylates.

The photopolymerization initiator is preferably a cationic photoinitiator when the base resin is cationically polymerizable as described above. Examples of cationic photoinitiators include iodonium salts, sulfonium salts, and triazine halides. Examples of commercially available cationic photopolymerization initiators useful in curing the base resin include Optomer SP-172 and Optomer SP-170 available from Adeka Corporation, WPAG-142 and WPAG-170 available from Wako Pure Chemical Industries, Ltd., and IRGACURE-261 available from Ciba Specialty Chemicals.

The photopolymerization initiator is preferably an anionic photoinitiator when the base resin is anionically polymerizable. Examples of anionic photoinitiators include alkyl lithium compounds.

The photopolymerization initiator is preferably a radical photoinitiator when the base resin is radically polymerizable. Examples of radical photoinitiators include benzoin ethers and aromatic ketones such as benzophenone and Michler's ketone (4,4'-bis(dimethylamino) benzophenone).

Examples of a negative-type photosensitive resin preferably used as the base resin herein include polyether amides having functional groups that are linked to each other in the presence of a cationic photoinitiator under acidic conditions.

The negative-type photosensitive resin is dissolved in an appropriate solvent, whereby a solution is prepared. The solution is formed into a layer by a spin-coating process or formed into films, which are laminated into a layer.

The content of the photopolymerization initiator in the first layer 6 is greater than the content of the photopolymerization initiator in the second layer 7. This allows the base resin to be cured securely by light irradiation to enhance the adhesion between the channel-forming member 4 and the substrate 1 and also allows the first layer 6, which directly contacts the ink, to have high hardness and high ink resistance. Therefore, the channel-forming member 4 has high reliability.

Second Embodiment

Figure 3A:
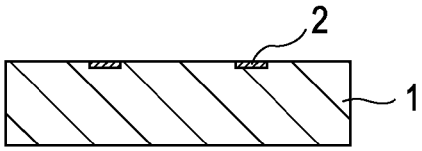
FIGS. 3A to 3G are cross-sectional illustrations showing steps of a method for manufacturing a liquid discharge head according to a second embodiment of the present invention.

A method for manufacturing a liquid discharge head according to a second embodiment of the present invention will now be described with reference to FIGS. 3A to 3G. FIGS. 3A to 3G are cross-sectional illustrations showing steps of the manufacturing method. As shown in FIG. 3A, a substrate 1 including energy-generating elements 2 is prepared.

Figure 3B:
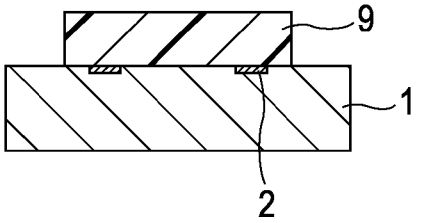

As shown in FIG. 3B, a pattern 9 for forming a channel 8 is formed on the substrate 1. A material for forming the pattern 9 is preferably a soluble resin and more preferably a positive-type photosensitive resin. The pattern 9 can be formed in such a manner that a layer of the positive-type photosensitive resin is deposited on the substrate 1 and is then patterned by photolithography.

Figure 3C:
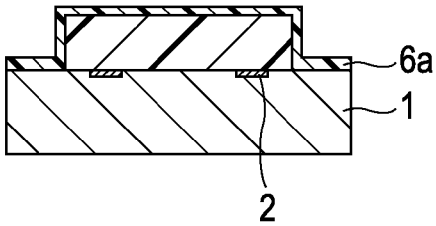

As shown in FIG. 3C, a first layer 6*a* is formed over the pattern 9. Portions of the first layer 6*a* that are not located on the pattern 9 are in contact with the substrate 1. A bonding layer for tightly bonding the substrate 1 and the first layer 6*a* together may be placed between the substrate 1 and the first layer 6*a*. The first layer 6*a* is made of a first negative-type photosensitive resin composition. The first negative-type photosensitive resin composition contains a base resin and a photopolymerization initiator.

Figure 3D:
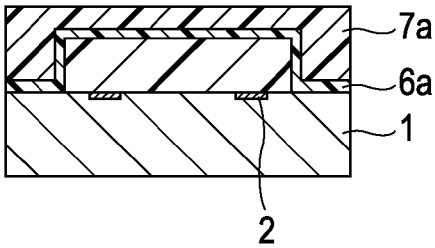

As shown in FIG. 3D, a second layer 7*a* is formed on the first layer 6*a*. The second layer 7*a* is made of a second negative-type photosensitive resin composition containing a base resin and a photopolymerization initiator. The first and second negative-type photosensitive resin compositions may contain the same or different base resin and photopolymerization initiator.

The content of the photopolymerization initiator in the first layer 6*a* (the percentage of the photopolymerization initiator in the first negative-type photosensitive resin composition on a weight percent basis) is greater than the content of the photopolymerization initiator in the second layer 7*a*. The content of the photopolymerization initiator in each of the first and second layers 6*a* and 7*a* may be arbitrarily selected such that the base resin is cured by exposure. The first layer 6*a* preferably has a thickness less than that of the second layer 7*a*. The thickness of the first layer 6*a* is preferably 15% to 50% of the sum of the first layer thickness and the second layer thickness. This is because the first layer 6*a* appropriately absorbs light and therefore light reaches a lower portion of the first layer 6*a* or a junction between the first layer 6*a* and the substrate 1. When the first layer 6*a* has a thickness less than the above range, the amount of light absorbed by the first layer 6*a* can be insufficient. The content of the photopolymerization initiator in each of the first and second negative-type photosensitive resin compositions has a great effect on the curing degree of the base resin. Since the first layer thickness and the photopolymerization initiator content are specified as described above, the adhesion between the substrate 1 and a channel-forming member 4 can be enhanced in a subsequent exposure step, and the curing degree of the base resin can be also increased, thereby allowing the channel 8 to have increased ink resistance.

Figure 3E:
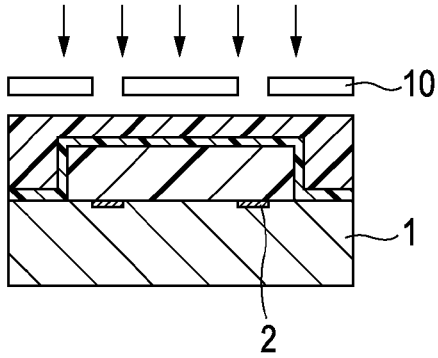

As shown in FIG. 3E, the first and second layers 6*a* and 7*a* are exposed using a mask 10 for forming discharge ports 5. The manufacturing method has an advantage that the first and second layers 6*a* and 7*a* can be cured to different degrees in one exposure step.

Figure 3F:
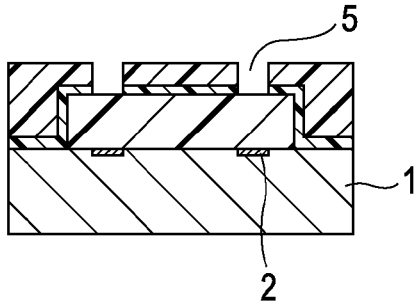

As shown in FIG. 3F, the resulting first and second layers 6*a* and 7*a* are developed, whereby the discharge ports 5 are formed.

Figure 3G:
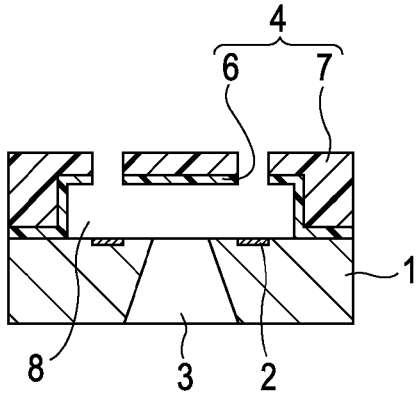

As shown in FIG. 3G, after a supply port 3 is formed, the pattern 9 is removed from the substrate 1, whereby the channel 8 is formed. According to the above procedure, the liquid discharge head can be obtained as shown in FIG. 2. Subsequently, the liquid discharge head is electrically connected to other components.

EXAMPLES

The present invention will be further described in detail with reference to examples below.

In Examples 1 to 5 and Comparative Examples 1 and 2, liquid discharge heads were manufactured by substantially the same procedure as that described above with reference to FIGS. 3A to 3G.

A layer of the acrylic photoresist ODUR 1010A available from Tokyo Ohka Kogyo Co., Ltd. was deposited on each substrate 1 with energy-generating elements 2 and was then patterned by photolithography, whereby a pattern 9 was formed as shown in FIG. 3B.

A first solution was prepared by dissolving about one part by weight of the epoxy resin EHPE 3150 available from Daicel Chemical Industries Ltd. and about 12 parts by weight of the cationic photoinitiator SP-172 available from Adeka Corporation in a solvent. A second solution was prepared by dissolving about one part by weight of the epoxy resin EHPE 3150 and about six parts by weight of the cationic photoinitiator SP-172 in the solvent. A first layer 6*a* and second layer 7*a* for forming a channel-forming member 4 were formed on the substrate 1 having the pattern 9 in that order using the first solution and the second solution, respectively, as shown in FIGS. 3C and 3D.

In Examples 1 to 5, the first and second layers 6*a* and 7*a* were formed so as to have different thicknesses.

The first and second layers 6*a* and 7*a* were exposed in one step with the substrate exposure system MPA-600 available from CANON KABUSHIKI KAISHA under conditions shown in Table 1 and were then developed, whereby discharge ports 5 with a diameter of about 8 μm were formed as shown in FIG. 3F.

The substrate 1 was anisotropically etched, whereby a supply port 3 was formed. The pattern 9 was removed from the substrate 1. In order to completely cure the epoxy resin, the first and second layers 6*a* and 7*a* were heated at about 200° C. for about one hour, whereby each liquid discharge head was obtained.

The liquid discharge heads of Comparative Example 1 had no first layer 6*a*, and the liquid discharge heads of Comparative Example 2 had no second layer 7*a*.

In order to check the influence of the exposure dose of the epoxy resin on the patterns 9, the patterns 9 were evaluated for cracks after the first and second layers 6*a* and 7*a* were exposed. A rating of A was given to the patterns 9 having no cracks. A rating of B was given to the patterns 9 having slight cracks causing no problem. A rating of C was given to the patterns 9 having more serious cracks.

The liquid discharge heads were evaluated for the adhesion between the channel-forming members 4 and the substrates 1. A rating of A was given to the liquid discharge heads in which there were no bonding failures between the channel-forming members 4 and the substrates 1. A rating of B was given to the liquid discharge heads in which there were slight bonding failures between the channel-forming members 4 and the substrates 1. A rating of C was given to the liquid discharge heads in which there were more serious bonding failures between the channel-forming members 4 and the substrates 1.

In the liquid discharge heads obtained, the discharge ports 5 were evaluated for morphology. A rating of A was given to the liquid discharge heads in which the discharge ports 5 had good morphology. A rating of B was given to the liquid discharge heads in which the discharge ports 5 had slightly unsatisfactory morphology causing no problem. A rating of C was given to the liquid discharge heads in which the discharge ports 5 had more seriously unsatisfactory morphology.

The liquid discharge heads were evaluated for their ability to form an image in such a manner that each liquid discharge head was attached to a printer, and images were printed on about 50,000 test sheets with the printer using ink containing about five parts of ethylene glycol, about three parts of urea, about two parts of isopropyl alcohol, about three parts of a black dye, and about 87 parts of water. A rating of A was given to the liquid discharge heads forming satisfactory images. A rating of B was given to the liquid discharge heads forming slightly unsatisfactory images. A rating of C was given to the liquid discharge heads forming more seriously unsatisfactory images. Table 1 summarizes the thicknesses of the first and second layers 6*a* and 7*a*, the exposure doses of the first and second layers 6*a* and 7*a*, and the evaluation results of the liquid discharge heads of Examples 1 to 5 and Comparative Examples 1 and 2. The thickness was determined after the solvent was removed from the first and second layers 6*a* and 7*a*. The cured first layer 6*a* has substantially the same thickness as that of the uncured first layer 6*a* and the cured second layer 7*a* has substantially the same thickness as that of the uncured second layer 7*a*.

TABLE 1

| | First layer thickness (μm) | Second layer thickness (μm) | Exposure dose (mJ/cm$^2$) | Cracks | Adhesion | Discharge port shape | Images |
|---|---|---|---|---|---|---|---|
| Example 1 | 1 | 19 | 750 | B | A | B | B |
| | | | 1000 | C | A | C | C |
| | | | 1200 | C | A | C | C |
| Example 2 | 3 | 17 | 750 | A | A | A | A |
| | | | 1000 | A | A | A | A |
| | | | 1200 | B | A | B | B |
| Example 3 | 5 | 15 | 750 | A | A | A | A |
| | | | 1000 | A | A | A | A |
| | | | 1200 | A | A | A | A |
| Example 4 | 10 | 10 | 750 | A | A | A | A |
| | | | 1000 | A | A | A | A |
| | | | 1200 | A | A | A | A |
| Example 5 | 15 | 5 | 750 | A | B | A | A |
| | | | 1000 | A | A | B | B |
| | | | 1200 | A | A | C | C |
| Comparative Example 1 | 20 | none present | 750 | A | C | B | B |
| | | | 1000 | A | B | C | C |
| | | | 1200 | A | B | C | C |
| Comparative Example 2 | none present | 20 | 750 | C | A | C | C |
| | | | 1000 | C | A | C | C |
| | | | 1200 | C | A | C | C |

As is clear from Table 1, the presence of the first layers 6*a* enhances the adhesion between the substrates 1 and the channel-forming members 4 and allows the discharge ports to have good morphology. In Examples 2 to 4, since the first layer thickness is about 15% to 50% of the sum of the first layer thickness and the second layer thickness, the patterns 9 have only slight cracks regardless of the fact that the exposure dose is high.

In Comparative Example 1, since the channel-forming members 4 include no second layers 7*a*, but the first layers 6*a* have a relatively high cationic photoinitiator content, the adhesion between the channel-forming members 4 and the substrates 1 is insufficient although the patterns 9 have only slight cracks. This is probably because the cationic photoinitiator in the first layers 6*a* did not sufficiently absorb light. An increase in exposure dose affects the morphology of the discharge ports 5.

In Comparative Example 2, since the channel-forming members 4 include no first layers 6*a*, but the second layers 7*a* have a relatively low cationic photoinitiator content, the patterns 9 have cracks. This is probably because the patterns 9 did not sufficiently absorb light.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-204961 filed Jul. 27, 2006, which is hereby incorporated by reference herein in its entirety.

What is claimed is:

1. A liquid discharge head comprising:

a substrate including energy-generating elements that generate energy used to discharge a liquid;

discharge ports through which the liquid is discharged; and a channel-forming member having a channel in which the liquid flows and which is communicatively connected to the discharge ports, wherein the channel-forming member includes a first layer and a second layer, the first and second layers are respectively formed from first and second negative-type photosensitive resin compositions containing a photopolymerization initiator, the first layer is located between the second layer and the substrate, and the content of the photopolymerization initiator in the first layer is greater than the content of the photopolymerization initiator in the second layer.

2. The liquid discharge head according to claim 1, wherein the second negative-type photosensitive resin composition contains an epoxy resin and a cationic photoinitiator.

3. The liquid discharge head according to claim 1, wherein the first and second negative-type photosensitive resin compositions contain an epoxy resin and a cationic photoinitiator.

4. The liquid discharge head according to claim 1, wherein the first and second negative-type photosensitive resin compositions contain the same resin.

5. The liquid discharge head according to claim 1, wherein the second layer has a thickness greater than that of the first layer.

6. The liquid discharge head according to claim 1, wherein the discharge ports are located at positions opposed to the energy-generating elements.

7. A method for manufacturing a liquid discharge head including a substrate having energy-generating elements that generate energy used to discharge a liquid, discharge ports through which the liquid is discharged, and a channel-forming member having a channel in which the liquid flows and which is communicatively connected to the discharge ports, the method comprising the steps of:

forming a pattern for the channel on the substrate;

forming a first layer on the pattern;

forming a second layer on the first layer;

exposing the first and second layers to form the discharge ports and the channel-forming member; and removing the pattern to form the channel, wherein the first and second layers are respectively formed from first and second negative-type photosensitive resin compositions containing a photopolymerization initiator and the content of the photopolymerization initiator in the first layer is greater than the content of the photopolymerization initiator in the second layer.

8. The method according to claim 7, wherein the second negative-type photosensitive resin composition contains an epoxy resin and a cationic photoinitiator.

9. The liquid discharge head according to claim 7, wherein the first and second negative-type photosensitive resin compositions contain an epoxy resin and a cationic photoinitiator.

10. The method according to claim 7, wherein the first and second negative-type photosensitive resin compositions contain the same resin.

11. The method according to claim 7, wherein the second layer has a thickness greater than that of the first layer.

12. The method according to claim 7, wherein the first and second layers contain the same photopolymerization initiator.

* * * * *